US005433840A

United States Patent [19]

Dahms et al.

[11] Patent Number: 5,433,840

[45] Date of Patent: Jul. 18, 1995

[54] ACID BATH FOR THE GALVANIC DEPOSITION OF COPPER, AND THE USE OF SUCH A BATH

[75] Inventors: Wolfgang Dahms; Horst Westphal; Michael Jonat, all of Berlin, Germany

[73] Assignee: Atotech Deutschland GmbH, Berlin, Germany

[21] Appl. No.: 193,016

[22] PCT Filed: Jul. 22, 1992

[86] PCT No.: PCT/DE92/00605

§ 371 Date: Apr. 6, 1994

§ 102(e) Date: Apr. 6, 1994

[87] PCT Pub. No.: WO93/03204

PCT Pub. Date: Feb. 18, 1993

[30] Foreign Application Priority Data

Aug. 7, 1991 [DE] Germany ..... 41 26 502.5

[51] Int. Cl.[6] ..... C25D 3/38

[52] U.S. Cl. ..... 205/296; 205/297; 205/298; 106/126

[58] Field of Search ..... 205/296, 297, 298, 239; 106/1.26; 568/607, 608, 611, 613

[56] References Cited

U.S. PATENT DOCUMENTS

| | | | |
|---|---|---|---|
| 3,743,584 | 7/1973 | Todt et al. | 205/298 |
| 4,820,388 | 4/1989 | Kurze et al. | 205/296 |
| 5,328,589 | 7/1994 | Martin | 106/1.26 |

FOREIGN PATENT DOCUMENTS

| | | | |
|---|---|---|---|
| 633957 | 5/1963 | Canada | 205/296 |
| 0071512 | 6/1985 | European Pat. Off. | C25D 3/38 |
| 1293749 | 4/1969 | Germany | 568/613 |
| 1521062 | 11/1971 | Germany | C23B 5/20 |
| 2039831 | 1/1979 | Germany . | |
| 2746938 | 4/1987 | Germany | C25D 3/38 |
| 3420999 | 10/1987 | Germany | C25D 3/38 |

*Primary Examiner*—John Niebling
*Assistant Examiner*—Edna Wong
*Attorney, Agent, or Firm*—Cohen, Pontani, Lieberman, Pavane

[57] ABSTRACT

An aqueous acid bath for the galvanic deposition of bright, ductile and smooth copper coats which is suitable for decorative purposes as well as for strengthening the conductors of printed circuits. The bath is characterized by a content of polyalkylene glycol ether. When combined with thio compounds containing water-soluble groups, these additions produce an electrolyte with excellent stability. Polymeric phenazonium compounds, polymeric nitrogen compounds and/or thio compounds containing nitrogen may also be successfully combined, in addition, depending on the desired properties.

25 Claims, No Drawings

ACID BATH FOR THE GALVANIC DEPOSITION OF COPPER, AND THE USE OF SUCH A BATH

BACKGROUND OF THE INVENTION

1. Field of the Invention

The invention is directed to an acid bath for the galvanic deposition of bright, ductile and smooth copper coats and to the use of this combination. The bath according to the invention can be used for strengthening the conductors of printed circuits as well as for decorative applications.

2. Description of the Prior Art

The addition of organic substances to galvanic copper baths to achieve bright depositions has been known for a long time. However, the numerous compounds which are already known for this purpose, e.g. thiourea, gelatins, molasses, coffee extract, "basic" dyestuffs and thiophosphoric acid esters, no longer have any practical significance, since the quality of the copper coats obtained by their use—in particular with respect to homogeneous appearance, hardness and breaking elongation—do not meet current requirements.

Baths containing a mixture of high-molecular compounds containing oxygen with organic, especially aromatic, thio compounds are known from the prior art (DE-AS 1521062). However, these baths yield unsatisfactory results with respect to control of metal and/or levelling or smoothing.

By way of improvement, DE-AS 2039831 describes an acid copper bath containing at least one dye from the polymeric phenazonium compound series in addition to a polymeric oxygen-containing compound and a thio compound with a water-soluble group. Other efforts describe the combination of organic thio compounds and polymeric oxygen-containing compounds with other dyes such as Crystal Violet (EP-PS 71512) or phthalocyanine derivatives with aposafranene (DE-PS 3420999) or a combination with amides (DE-PS 2746938).

A disadvantage in the use of conventional oxygen-containing high-molecular compounds is the stability in the electrolyte. In normal use, these compounds slowly decompose during the electrolysis into water-insoluble polymers which continue to build up in the electrolyte, form a jelly-like border around the walls, and are finally deposited on the goods themselves so that these goods are marred by defects which render them unusable. This decomposition is extremely intensified when the bath temperature rises above 28° C.

SUMMARY AND DESCRIPTION OF THE INVENTION

The present invention has the object of preventing these disadvantages.

This object is met according to the invention by an acid bath containing at least one polyalkylene glycol ether of the general formula $$[R^1-O(CH_2CH_2O)_n(\underset{\underset{CH_3}{|}}{CH}-CH_2O)_m-R^2]_a,$$

where n=8–800, preferably 14–90, and m=0–50, preferably 0–20, $R^1$ is a low alkyl $C_1$ to $C_4$, $R^2$ is an aliphatic chain or an aromatic group, and a is either 1 or 2.

The amount of polyalkylene glycol ether which can be added to achieve a significant improvement of the copper deposition is approximately 0,005 to 30 g/liter, preferably 0.02 to 8.0 g/liter. The relative molecular mass can be between 500 and 35000 g/mole, preferably between 800 and 4000 g/mole.

The polyalkylene glycol ethers are known per se or can be produced according to processes which are known per se by converting polyalkylene glycols with an alkylating agent such as dimethyl sulfate or tert.butene.

Examples of the polyalkylene glycol ethers used according to the invention and the preferred concentrations in which they are used are listed in Table 1:

TABLE 1

| polyalkylene glycol ether | preferred concentration g/liter |
|---|---|
| dimethyl polyethylene glycol ether | 0.1–5.0 |
| dimethyl polypropylene glycol ether | 0.05–1.0 |
| di-tert.-butyl polyethylene glycol ether | 0.1–2.0 |
| stearyl monomethyl polyethylene glycol ether | 0.5–8.0 |
| nonylphenol monomethyl polyethylene glycol ether | 0.5–6.0 |
| polyethylene polypropylene dimethyl ether (mixed or block polymer) | 0.02–5.0 |
| octyl monomethyl polyalkylene ether (mixed or block polymer) | 0.05–0.5 |
| dimethyl-bis(polyalkyleneglycol)octylene ether (mixed or block polymer) | 0.02–0.5 |
| β-naphthol monomethyl polyethylene glycol ether | 0.03–4.0 |

1 abbreviated name dimethyl polyalkylene glycol ether.

At least one thio compound with a hydrophilizing group can be added to the compound according to the invention in order to obtain a bright deposit. Other additions, such as nitrogen-containing thio compounds, polymeric nitrogen compounds and/or polymeric phenazonium compounds can also be added to the bath.

These individual components of the copper bath according to the invention can generally be advantageously contained in the finished bath within the following limiting concentrations:

| conventional organic thio compounds | |
|---|---|
| with water-soluble groups | 0.0005–0.4 g/liter |
| preferably | 0.001–0.15 g/liter. |

Some conventional thio compounds with water-soluble groups and their preferred use concentrations are listed in Table 2:

TABLE 2

| thio compounds | preferred concentration g/liter |
|---|---|
| 3-mercaptopropane-1-sulfonic acid, sodium salt | 0.002–01 |
| thiophosphoric acid-O-ethyl-bis-(ω-sulfopropyl)ester, disodium salt | 0.01–0.15 |
| thiophosphoric acid-tris-(ω-sulfopropyl) ester, trisodium salt | 0.02–0.15 |
| thioglycolic acid | 0.001–0.005 |
| ethylene dithio dipropyl sulfonic acid, sodium salt | 0.001–0.1 |
| bis-(ω-sulfopropyl)disulfide, disodium salt | 0.001–0.05 |
| bis-(ω-sulfopropyl)sulfide, disodium salt | 0.01–0.15 |
| O-ethyl dithiocarbonic acid-S-(ω-sulfopropyl)ester, potassium salt | 0.002–0.05 |
| 3(benzothiazolyl-2-thio)propylsulfonic acid, sodium salt | 0.005–0.1 |
| bis-(ω-sulfohydroxypropyl)disulfide, disodium salt | 0.003–0.04 |

TABLE 2-continued

| thio compounds | preferred concentration g/liter |
|---|---|
| bis-(ω-sulfobutyl)disulfide, disodium salt | 0.004–0.04 |
| bis-(p-sulfophenyl)disulfide, disodium salt | 0.004–0.04 |
| methyl-(ω-sulfopropyl)disulfide, disodium salt | 0.007–0.08 |
| methyl-(ω-sulfopropyl)trisulfide, disodium salt | 0.005–0.03. |

Conventional nitrogen-containing thio compounds (so-called thiourea derivatives) and/or polymeric phenazonium compounds and/or polymeric nitrogen compounds
0.0001–0.50 g/liter,
preferably 0.0005–0.04 g/liter.

Table 3 contains examples for nitrogen-containing thio compounds (so-called thiourea derivatives); Table 4 shows examples for polymeric phenazonium compounds; and Table 5 shows examples for polymeric nitrogen compounds.

TABLE 3

| Nitrogen-containing thio compounds |
|---|
| N-acetylthiourea |
| N-trifluoroacetylthiourea |
| N-ethylthiourea |
| N-cyanoacetylthiourea |
| N-allylthiourea |
| o-tolylthiourea |
| N,N'-butylene thiourea |
| thiazolidine thiol(2) |
| 4-thiazoline thiol(2) |
| imidazolidine thiol(2) (N,N'-ethylene thiourea) |
| 4-methyl-2-pyrimidine thiol |
| 2-thiouracil |

1 Table 3 to 5 can be omitted if desired.

TABLE 4

| Polymeric phenazonium compounds |
|---|
| poly(6-methyl-7-dimethylamino-5-phenyl phenazonium sulfate) |
| poly(2-methyl-7-diethylamino-5-phenyl phenazonium chloride) |
| poly(2-methyl-7-dimethylamino-5-phenyl phenazonium sulfate) |
| poly(5-methyl-7-dimethylamino phenazonium acetate) |
| poly(2-methyl-7-anilino-5-phenyl phenazonium sulfate) |
| poly(2-methyl-7-dimethylamino phenazonium sulfate) |
| poly(7-methylamino-5-phenyl phenazonium acetate) |
| poly(7-ethylamino-2,5-diphenyl phenazonium chloride) |
| poly(2,8-dimethyl-7-diethylamino-5-p-tolyl-phenazonium chloride) |
| poly(2,5,8-triphenyl-7-dimethylamino phenazonium sulfate) |
| poly(2,8-dimethyl-7-amino-5-phenyl phenazonium sulfate) |
| poly(7-dimethylamino-5-phenyl phenazonium chloride) |

TABLE 5

| Polymeric nitrogen compounds |
|---|
| polyethylenimine |
| polyethylenimide |
| polyacrylic acid amide |
| polypropylenimine |
| polybutylenimine |
| N-methylpolyethylenimine |
| N-acetylpolyethylenimine |
| N-butylpolyethylenimine |

The basic composition of the bath according to the invention can fluctuate within wide limits. In general, an aqueous solution of the following composition is used:

| | |
|---|---|
| copper sulfate ($CuSO_4.5H_2O$) | 20–250 g/liter |

-continued

| | |
|---|---|
| preferably | 60–80 g/liter or 180–220 g/liter |
| sulfuric acid | 50–350 g/liter |
| preferably | 180–220 g/liter or 50–90 g/liter |
| chloride ions | 0.01–0.18 g/liter |
| preferably | 0.03–0.10 g/liter. |

Other copper salts may be used, at least in part, instead of copper sulfate. Sulfuric acid can also be replaced entirely or in part by fluoroboric acid, methanesulfonic acid or other acids. The chloride ions are added as alkaline chloride (e.g. sodium chloride) or in the form of hydrochloric acid p.a. The addition of sodium chloride may be dispensed with entirely or in part if halogen ions are already contained in the additions.

Further, conventional brighteners, smoothing agents or wetting agents can also be contained in addition.

The individual components of the basic composition are added for the production of the bath according to the invention.

The operating conditions of the bath are as follows:

| | |
|---|---|
| pH: | <1 |
| temperature: | 15° C.–50° C., preferably 25° C–40° C. |
| cathodic current density: | 0.5–12 A/dm$^2$, preferably 2–7 A/dm$^2$. |

The electrolytic movement is effected by blowing in clean air with sufficient intensity to cause a strong fluttering of the electrolyte surface.

Copper containing 0.02 to 0.067% phosphorus is used as anode.

The following examples serve to explain the invention:

EXAMPLE 1

0.2 g/liter polyethylene glycol,
0.01 g/liter bis-(ω-sulfopropyl)disulfide, disodium salt,
and
0.02 g/liter polymeric 7-dimethylamino-5-phenyl phenazonium chloride
are added as brighteners to a copper bath of the following composition:
200.0 g/liter copper sulfate ($CUSO_4 \cdot 5\ H_2O$)
65.0 g/liter sulfuric acid
0.12 g/liter sodium chloride.
At an electrolyte temperature of 30° C. with a current density of 4 A/dm$^2$ and movement by means of blown in air, a bright copper coat with good smoothness is obtained.

If the electrolyte is subjected to a steady load of 500 Ah/l and the brighteners consumed during the electrolysis are supplemented to reference values, the electrolyte presents distinct jelly-like polymer edges at the edge of the bath.

However, when the compound according to the invention, polyethylene glycol dimethyl ether, is added to the electrolyte instead of the polyethylene glycol, but in the same quantity, the electrolyte shows no polymer edges after aging.

EXAMPLE 2

0.6 g/liter polypropylene glycol, 0.02 g/liter 3-mercaptopropane-1-sulfonic acid, disodium salt, and 0.003 g/liter N-acetylthiourea are added as brighteners to a copper bath of the following composition:

80 g/liter copper sulfate ($CUSO_4$ 5 $H_2O$)

180 g/liter sulfuric acid 0.08 g/liter sodium chloride.

Bright deposits are achieved on a scratched copper laminate at an electrolyte temperature of 30° C. with a current density of 2 A/dm$^2$.

If the electrolyte is subjected to a steady load of 500 Ah/l and the brighteners consumed during the electrolysis are supplemented to reference values, the electrolyte presents distinct jelly-like polymer edges at the edge of the bath.

However, when the compound according to the invention, polypropylene glycol dimethyl ether, is added to the electrolyte instead of polypropylene glycol, but in the same quantity, the electrolyte shows no polymer edges after aging.

EXAMPLE 3

0.4 g/liter octyl polyalkyl ether, 0.01 g/liter bis-(ω-sulfopropyl)sulfide, disodium salt, and 0.01 g/liter polyacrylic acid amide are added as brighteners to a copper bath of the following composition:

80 g/liter copper sulfate ($CUSO_4$·5 $H_2O$)

200 g/liter concentrated sulfuric acid 0.06 g/liter sodium chloride.

Bright deposits are achieved on a scratched copper laminate at an electrolyte temperature of 30° C. with a current density of 2 A/dm$^2$.

If the electrolyte is subjected to a steady load of 500 Ah/l and the brighteners consumed during the electrolysis are supplemented to reference values, the electrolyte presents distinct jelly-like polymer edges at the edge of the bath.

However, when the compound according to the invention, octyl monomethyl polyalkyl glycol, is added to the electrolyte instead of octyl polyalkyl glycol, but in the same quantity, the electrolyte shows no polymer edges after aging.

EXAMPLE 4

A copper sheet of 40 μm which was precipitated from a copper bath of the following composition:

80 g/liter copper sulfate ($CUSO_4$·5 $H_2O$)

200 g/liter concentrated sulfuric acid 0.06 g/liter sodium chloride shows a breaking elongation of 4.2%. After dissolving 0.4 g/liter dimethyl polyalkyl ether in the electrolyte, a sheet deposited under the same conditions shows a breaking elongation of 12.3%.

We claim:

1. An aqueous acid bath for the galvanic deposition of bright, smooth copper coats comprising:

a polyalkylene glycol ether of the formula $$[R^1-O(CH_2CH_2O)_n(\underset{\underset{CH_3}{|}}{CH}-CH_2O)_m-R^2]_a,$$

where n=8–800, and m=0–50, $R^1$ is a lower alkyl group having one to four carbon atoms, $R^2$ is an aliphatic chain or an aromatic group, and a is 1 or 2;

a copper salt;

an acid; and optionally, chloride ions.

2. An aqueous acid bath according to claim 1, wherein n=14–90.

3. An aqueous acid bath according to claim 1, wherein the polyalkylene glycol ether is present in a concentration of 0.005 to 30 g/liter.

4. An aqueous acid bath according to claim 1, wherein the polyalkylene glycol ether is selected from the group consisting of:

dimethyl polyethylene glycol ether;

dimethyl polypropylene glycol ether;

di-tert.-butyl polyethylene glycol ether;

stearyl monomethyl polyethylene glycol ether;

nonylphenol monomethyl polyethylene glycol ether;

polyethylene polypropylene dimethyl glycol ether;

octyl monomethyl polyalkylene ether;

dimethyl-bis(polyalkyleneglycol)octylene ether; and 3-naphthol monomethyl polyethylene glycol ether.

5. An aqueous acid bath according to claim 1, further comprising at least one thio compound or a mixture thereof.

6. An aqueous acid bath according to claim 5, wherein the thio compound is selected from the group consisting of:

3-mercaptopropaneo 1 -sulfonic acid, sodium salt;

thiophosphoric acid-O-ethyl-bis-(ω-sulfopropyl)ester, disodium salt;

thiophosphoric acid-tris-(ω-sulfopropyl)ester, trisodium salt;

thioglycolic acid;

ethylene dithio dipropyl sulfonic acid, sodium salt;

bis-(ω-sulfopropyl)disulfide, disodium salt;

bis-(ω-sulfopropyl)sulfide, disodium salt;

O-ethyl dithiocarbonic acid-S-(ω-sulfopropyl)ester, potassium salt

3(benzothiazolyl-2-thio)propylsulfonic acid, sodium salt;

bis-(ω-sulfohydroxypropyl)disulfide, disodium salt;

bis-(ω-sulfobutyl)disulfide, disodium salt;

bis-(p-sulfophenyl)disulfide, disodium salt;

methyl-(ω-sulfopropyl)disulfide, disodium salt; and methyl-(ω-sulfopropyl)trisulfide, disodium salt.

7. An aqueous acid bath according to claim 5, wherein the thio compound is present in a concentration of 0.0005 to 0.4 g/liter.

8. An aqueous acid bath according to claim 6, wherein the thio compound is present in a concentration of 0.0005 to 0.4 g/liter.

9. An aqueous acid bath according to claim 1, further comprising at least one polymeric phenazonium compound.

10. An aqueous acid bath according to claim 9, wherein the polymeric phenazonium compound is selected from the group consisting of:

poly(6-methyl-7-dimethylamino-5-phenyl phenazonium sulfate);

poly(2-methyl-7-diethylamino-5-phenyl phenazonium chloride);

poly(2-methyl-7-dimethylamino-5-phenyl phenazonium sulfate);

poly(5-methyl-7-dimethylamino phenazonium acetate);

poly(2-methyl-7-anilino-5-phenyl phenazonium sulfate);

poly(2-methyl-7-dimethylamino phenazonium sulfate);

poly(7-methylamino-5-phenyl phenazonium acetate);

poly(7-ethylamino-2,5-diphenyl phenazonium chloride);

poly(2,8-dimethyl-7-diethylamino-5-p-tolyl-phenazonium chloride);

poly(2,5,8-triphenyl-7-dimethylamino phenazonium sulfate);

poly(2,8-dimethyl-7-amino-5-phenyl phenazonium sulfate); and poly(7-dimethylamino-5-phenyl phenazonium chloride).

11. An aqueous acid bath according to claim 9, wherein the polymeric phenazonium compound is present in a concentration of 0.0001 to 0.5 g/liter.

12. An aqueous acid bath according to claim 10, wherein the polymeric phenazonium compound is present in a concentration of 0.0001 to 0.5 g/liter.

13. An aqueous acid bath according to claim 1, further comprising at least one thiourea derivative.

14. An aqueous acid bath according to claim 10, wherein the thiourea derivative is selected from the group consisting of:

N-acetylthiourea;
N-trifluoroacetylthiourea;
N-ethylthiourea;
N-cyanoacetylthiourea;
N-allylthiourea;
o-tolylthiourea;
N,N'-butylene thiourea;
thiazolidine thiol(2);
4-thiazoline thiol(2);
imidazolidine thiol(2) (N,N'-ethylene thiourea);
4-methyl-2-pyrimidine thiol; and
2-thiouracil.

15. An aqueous acid bath according to claim 13, wherein the thiourea derivative is present in a concentration of 0.0001 to 0.5 g/liter.

16. An aqueous acid bath according to claim 14, wherein the thiourea derivative is present in a concentration of 0.0001 to 0.5 g/liter.

17. An aqueous acid bath according to claim 1, further comprising at least one polymeric nitrogen compound.

18. An aqueous acid bath according to claim 17, wherein the polymeric nitrogen compound is selected from the group consisting of:

polyethylenimine;
polyethylenimide;
polyacrylic acid amide;
polypropylenimine;
polybutylenimine;
N-methylpolyethylenimine;
N-acetylpolyethylenimine; and
N -butylpolyethylenimine.

19. An aqueous acid bath according to claim 17, wherein the polymeric nitrogen compound is present in a concentration of 0.0001 to 0.5 g/liter.

20. An aqueous acid bath according to claim 18, wherein the polymeric nitrogen compound is present in a concentration of 0.0001 to 0.5 g/liter.

21. A method for strengthening conductors of printed circuits, comprising the steps of:

(a) providing an aqueous acid bath containing a polyalkylene glycol ether of the formula $$[R^1-O(CH_2CH_2O)_n(\underset{\underset{CH_3}{|}}{CH}-CH_2O)_m-R^2]_a,$$

where n=8–800, and m=0–50, $R^1$ is a lower alkyl group having one to four carbon atoms, $R^2$ is an aliphatic chain or an aromatic group, and a is 1 or 2, a copper salt, an acid, and optionally, chloride ions;

(b) immersing the printed circuit in the aqueous acidic bath; and (c) galvanizing the printed circuit to deposit a bright, smooth copper coat.

$$[R^1-O(CH_2CH_2O)_n(\underset{\underset{CH_3}{|}}{CH}-CH_2O)_m-R^2]_a,$$

where n=8–800, and m=0–50, $R^1$ is a lower alkyl group having one to four carbon atoms, $R^2$ is an aliphatic chain or an aromatic group and a is 1 or 2;

a copper salt;

an acid; and optionally, chloride ions.

22. A method for producing bright, smooth copper coats on printed circuits, comprising the steps of:

(a) providing an aqueous acid bath containing a polyalkylene glycol ether of the formula $$[R^1-O(CH_2CH_2O)_n(\underset{\underset{CH_3}{|}}{CH}-CH_2O)_m-R^2]_a,$$

where n=8–800, and m=0–50, $R^1$ is a lower alkyl group having one to four carbon atoms, $R^2$ is an aliphatic chain or an aromatic group, and a is 1 or 2;

a copper salt, an acid, and optionally, chloride ions;

(b) immersing the printed circuit in the aqueous acidic bath; and (c) galvanizing the printed circuit to deposit a bright, smooth, copper coat.

23. An aqueous acid bath according to claim 1, wherein the copper salt is present in a concentration of from 20 to 250 g/liter, the acid is present in a concentration of from 50 to 350 g/liter, and the chloride ions are present in a concentration of from 0.01 to 0.18 g/liter.

24. The method for strengthening conductors of printed circuits according to claim 21, wherein the copper salt is present in a concentration of from 20 to 250 g/liter, the acid is present in a concentration of from 50 to 350 g/liter, and the chloride ions are present in a concentration of from 0.01 to 0.18 g/liter.

25. The method for producing bright, smooth copper coats according to claim 22, wherein the copper salt is present in a concentration of from 20 to 250 g/liter, the acid is present in a concentration of from 50 to 350 g/liter, and the chloride ions are present in a concentration of from 0.01 to 0.18 g/liter.

* * * * *